US006655295B2

(12) United States Patent
Baumgartner et al.

(10) Patent No.: US 6,655,295 B2
(45) Date of Patent: Dec. 2, 2003

(54) SMALL-CALIBRE DEFORMATION PROJECTILE AND METHOD FOR THE MANUFACTURE THEREOF

(75) Inventors: Hans Baumgartner, Thun (CH); Rolf Schneider, Wichtrach (CH); Carl Hug, Oberdiessbach (CH); Donald Meyer, Villarepos (CH)

(73) Assignee: Ruag Munition, Thun (CH)

( * ) Notice: Subject to any disclaimer, the term of this patent is extended or adjusted under 35 U.S.C. 154(b) by 0 days.

(21) Appl. No.: 10/295,716

(22) Filed: Nov. 15, 2002

(65) Prior Publication Data

US 2003/0167954 A1 Sep. 11, 2003

Related U.S. Application Data

(63) Continuation of application No. PCT/CH01/00294, filed on May 14, 2001.

(30) Foreign Application Priority Data

May 15, 2000 (EP) ..... 00810418

(51) Int. Cl.[7] ..... F42B 10/00

(52) U.S. Cl. ..... 102/510

(58) Field of Search ..... 102/510, 507, 102/508, 500

(56) References Cited

U.S. PATENT DOCUMENTS

| | | | | | |
|---|---|---|---|---|---|
| 843,017 | A | * | 2/1907 | Hoxie | 102/510 |
| 896,021 | A | * | 8/1908 | Hoxie | 102/510 |
| 4,665,827 | A | * | 5/1987 | Ellis, II | 102/510 |
| 4,685,397 | A | * | 8/1987 | Schirneker | 102/510 |
| 5,760,329 | A | * | 6/1998 | Baum et al. | 102/439 |
| 2002/0139275 | A1 | * | 10/2002 | Jensen | 102/510 |

* cited by examiner

*Primary Examiner*—Charles T. Jordan
*Assistant Examiner*—Jordan Lofdahl
(74) *Attorney, Agent, or Firm*—Schweitzer Cornman Gross & Bondell, LLP

(57) ABSTRACT

A small calibre projectile has an outer hollow cylindrical base member and a conical or ogive front region constructed to mushroom upon impact. A sleeve core is inserted into the cylindrical base member with a non-positive fit, the core extending beyond the front of the base member with a hollow space between the rear of the core and the rear of the base. Upon impact, the core is displaced axially into the space with its rear in contact with the base.

9 Claims, 4 Drawing Sheets

SMALL-CALIBRE DEFORMATION PROJECTILE AND METHOD FOR THE MANUFACTURE THEREOF

The present application is a continuation of PCT/CH01/00294, filed May 14, 2001.

The present invention relates to small-calibre ammunition.

BACKGROUND OF THE INVENTION

It is generally well-known that the high penetration capacity of the ammunition used in instances of police action often leads to shots passing cleanly right through, so that the person hit is not effectively prevented from resistance and/or is able to flee. Ricochets also lead to disintegration of the ammunition, and frequently endanger persons not involved. In addition, commonly used projectiles have a lead core, which has an unacceptable and adverse long-term effect on the person hit and on the environment.

A projectile, especially for hand guns, is known (EP-B1-0 636 853), which comprises a cylindrical base member of metal, the leading end of which is in the form of an ogive or truncated cone, a ballistic additional member in the form of a ball of impact-resistant plastics material being inserted in this base member. This projectile is particularly intended to not form secondary projectiles.

Such a ball for small-calibre ammunition that becomes detached from the base member in the target is difficult to detect in a wounded person, since even when metals are added to the plastics material there is only a very small effective cross-section for ray detection. Such a ball that has become detached from the base member can therefore remain undetected, especially in the vicinity of bone, even when using a high-resolution ray apparatus, and can lead to lasting, permanent disorders in the human body.

A two-part construction of the projectile using different materials is also a disadvantage, giving rise on the one hand to manufacturing problems and, on the other hand, on account of the limited final ballistic energy, failing to provide an energy deposition stipulated in police circles of about 60 J/cm in the case of 9 mm ammunition, at a target distance of 5 m, measured in so-called ballistic soap.

U.S. Pat. No. 4,136,616 discloses projectiles having a projectile in the form of a cylindrical main body with a central projecting top or circumferential ring. A so-called ballistic cap encloses a cavity, which carries a thorn-like spike on its base. On impact on the target, in one variant of the projectile the cap is deformed and pierced; it unrolls peripherally around the spike so that the resulting hollow cylinder of the base member opened at the front is able to mushroom and deliver its kinetic energy to the target over a correspondingly enlarged area. In another variant, the cavity is filled with gunpowder and ignites, or explosively severs the ballistic cap before the target is reached. Further embodiments are designed for hunting and recreational shooting and in some cases have complicated turned parts which are pressed by the target into more or less conically shaped bores or straight slots and allow the base body to expand. Individual constructions can even be mechanically adjusted prior to shooting in respect of their later penetration behaviour. The feature common to all the variants is that the inner displaceable core, that is, the ballistic cap, either runs onto a spike or is in the form of a solid body and/or a conical annular region provided to ensure mushrooming.

The drawback to all of these constructions is that they have relatively complicated component parts, which are manufactured at least partly on metal-cutting tools. Material deformation in the target is dependent on many parameters, so that consistent dispersion patterns or defined energy depositions cannot be expected.

BRIEF DESCRIPTION OF THE INVENTION

It is therefore an object of the present invention to eliminate the disadvantages of conventional projectiles and to produce a small-calibre projectile that causes high energy deposition with a direct hit, that is, puts the person hit out of action, without causing lasting injury as a consequence of dispersed pieces of projectile and/or highly toxic heavy metals. The projectile is furthermore capable of being adapted to the conditions for police action and have great reliability and precision. In addition, it is possible to manufacture the projectile economically and in particular without any complicated turned parts being required.

In accordance with the foregoing and other objects, a small calibre deformation projectile of the present invention includes a hollow cylindrical base with a sleeve core inserted into and projecting beyond the base member. The sleeve core is slidably inserted into the base member. On impact with the target the sleeve core is displaced axially into an annular space in the base member behind the sleeve core into a rear position with its end face in contact with the base member.

An interference fit between the sleeve and base may be selected so that an inner cylindrical part of the sleeve core is firmly held over its full length by a non-positive fit and in a front position in the base member throughout the entire ballistic trajectory, moving to a rear position in contact with the base body upon target contact. Alternatively it may be selected so that the sleeve can be displaced into a rear position by the firing acceleration. The over-dimension of the fit necessary for this is advantageously affected on a hole-basis system of fits.

The subject matter of the invention poses minimum threat to the environment despite high penetration capacity against hard targets. The projectile deformation, that is, mushrooming, is effected in a specific manner and is predictable in its effect; the energy release in biological material is controlled. The appearance of the projectile is that of a full jacketed projectile, and has the advantages thereof, that is, no moisture is able to penetrate into the propelling charge.

The projectile does not disintegrate in a target; the projectile found in a target in all cases had 100% of its original weight. The air space present between the base member and the inserted sleeve core acts like a dynamic spring on impact on a soft target (ballistic soap); deformation is effected only in the frontal region of the base member, the sleeve core being displaced rearwardly into the annular space at the rear side itself absorbs virtually no deformation energy.

Deformation is initiated by the above-mention translatory movement, so that the resulting projecting front region of the base member is relatively easily deformable and mushrooms on impact on hard targets in the manner of a flanging on both sides, that is, it spreads. On softer targets, there is bulging accompanied by a frontal cross-sectional enlargement. This type of compaction of the two parts prevents dissociation even in very hard targets.

It has unexpectedly been found that, as tests have shown, materials such as clothing etc. in front of the target do not adversely affect deformation of the projectile.

A further advantage consists in the minimal resulting mechanical stress on the weapon during firing; the compressibility, especially of the rear part of the projectile, reduces wear in the barrel, so that projectiles according to the invention are also particularly suitable for practice ammunition. In that connection, it is also beneficial that the entire projectile body consists of a single, easily recycled material and can be cleared from target areas so that the environment is not harmed.

A manufacturing process for the projectile in which the base member and sleeve core are produced by a deep drawing and molding process and the sleeve core is pressed into the loose member with a force fit to create a full-width hollow space allows economical large-scale series fabrication.

The choice of an identical material for the base member and the sleeve core not only has benefits for manufacture; the materials also have an identical thermal expansion, so that parts, once joined together, have the same stress.

The inclusion of an external annular groove at the front end also produces in the base member a space for partially receiving the sleeve core that has become compressed on entering the target.

Analogously, an additional deformation zone can be produced in the sleeve core, in that an external annular groove may be provided there.

Apart from the customary fits for an interference fit, for example, H7/n6, when the sleeve core is not intended to be displaced until the projectile is in the target, and a holding fit when the sleeve core is intended to be displaced at even low firing accelerations, the sleeve core can be of conical construction compared with the bore in order to achieve an interference fit with a matching effect. The reverse option is likewise possible, that is, the bore can be conical as opposed to the sleeve core.

Manufacture of the two parts base member and sleeve core is especially economical through the use of deep drawing processes known per se.

A further increase in efficiency in manufacture is possible by the use of flat strip stock, which is fed via a roller to the relevant stamping press. Precise joining of the two parts may be effected by means of a shaping die, which presses the sleeve core at its end face with a positive fit into the base member.

BRIEF DESCRIPTION OF THE DRAWINGS

Exemplary embodiments of the invention are explained below with reference to the annexed drawings, in which.

DETAILED DESCRIPTION OF THE INVENTION

Figure 1:
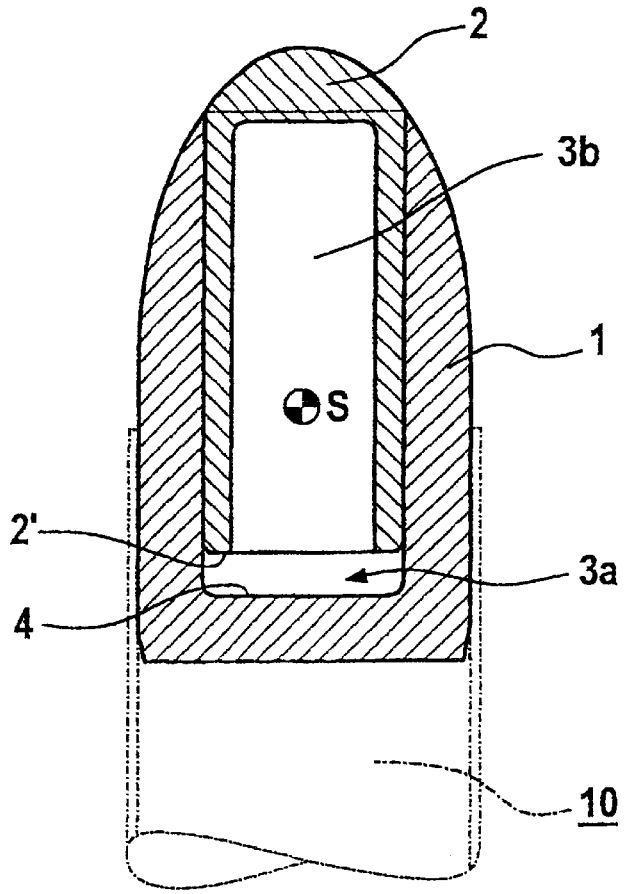
FIG. 1 shows, in sectional view, a projectile according to the invention for pistol ammunition.

In FIG. 1, a cylindrical base member is denoted by the numeral 1. This base member is pressed in a known manner into the casing 10 of a cartridge for pistol ammunition.

In the base member 1 there is an additional member in the form of a sleeve core 2 which, together with the base member, forms, with no transitions, a conical or ogive projectile tip region. In the lower region of the projectile there is a circular disc-shaped annular space 3*a*, which, together with the blind bore 3*b* above it in the sleeve core 2, forms an enclosed air space.

A circular symbol, denoted by the letter S, the centre of gravity of the projectile, is also marked in FIG. 1.

The end face 2' of the sleeve core 2 spaced from the bottom 4 of the base member is displaced in a translatory movement when the projectile hits a target and strikes against the bottom 4. It is therefore possible to deform the projectile tip in a specific manner; it mushrooms and at the same time surrounds the tip of the sleeve core 2 at the edge with a flange.

Even if the translatory displacement should be effected only to a slight extent on account of the selected mass ratios between the base member and sleeve core, the base member and the sleeve core are wedged together, so that the entire mass of the discharged projectile is preserved intact in the target, as demonstrated by practical tests with weight measurements.

On the one hand, this produces an energy conversion, and on the other hand the front end outer diameter of the projectile enlarges, so that the delivery of energy to the target is intensified on the basis of the larger surface area.

The positive engagement of the two parts, which is effected in the manner of riveting, imparts high mechanical strength to the projectile; in the case of a hard target it behaves like a solid body projectile, without having the disadvantages thereof.

The deformation of the projectile can be predetermined in wide limits by means and features known per se; in particular, these include the choice of the hardness and ductility of the materials and the corresponding dimensioning of the projectile parts.

Figure 2:
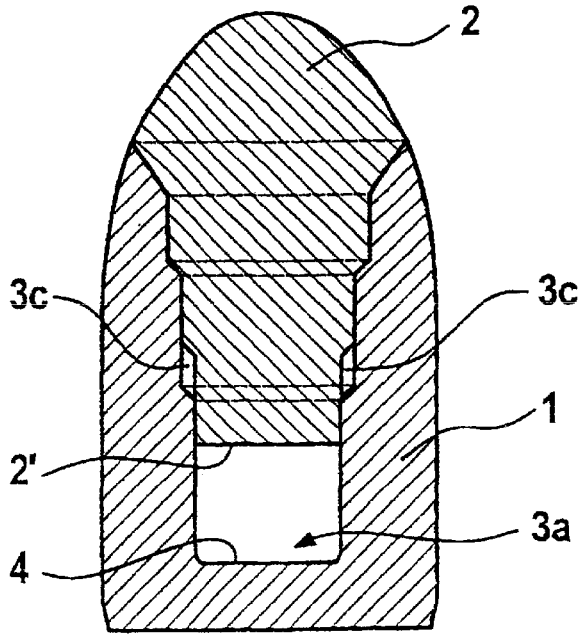
FIG. 2 shows a first variant of the projectile, having an effect analogous to that of FIG. 1.

The variant shown in FIG. 2 has a larger mass compared with the construction shown in FIG. 1, the deformation in the target causes only mushrooming, which is facilitated by the peripheral annular space 3*c*. The hollow space 3*a* has approximately the same volume as it does in FIG. 1, but has a smaller diameter, so that the axial displacement path for the sleeve core 2 is longer.

Figure 3A:
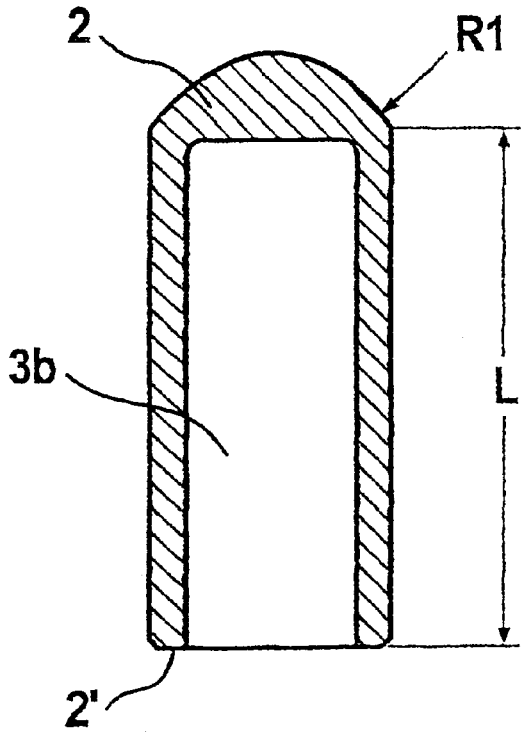
FIG. 3*a* and FIG. 3*b* show the two component parts of the projectile shown in FIG. 1, prior to assembly.
Figure 3B:
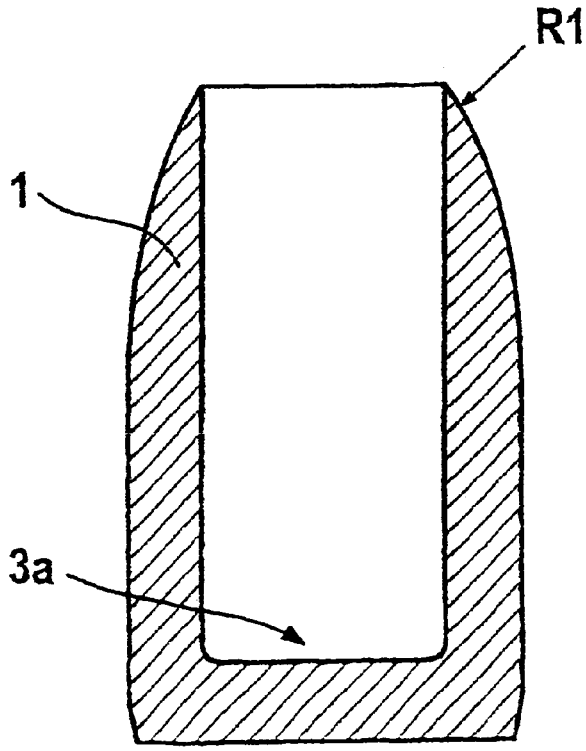

The constituent parts of the two-part projectile prior to assembly are illustrated in FIGS. 3*a* and 3*b*.

From FIG. 3*a* in conjunction with FIG. 3*b*, it is apparent that the radius $R_1$ of the ogive tip is the same in the transition regions of the sleeve core 2 and the base member. In addition, the length L of the cylindrical part of the sleeve core 2 is shown, which is always shorter than that of the corresponding recess in the base member 1.

The diameters of the parts of the base member 1 and the sleeve core 2 which mate or slide together are matched to one another in the manner of a so-called press fit (force fit), a conicity of 0.06 mm facilitating assembly at room temperature yet ensuring that the parts hold together over the entire ballistic trajectory and in the target even in the case of any temperature gradient between the parts.

Figure 4:
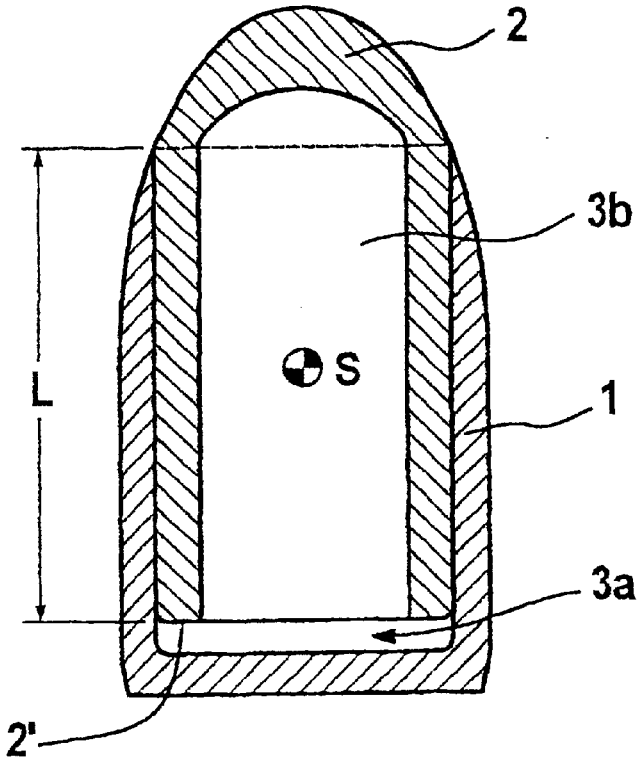
FIG. 4 shows a second variant of a projectile with reduced ricochet behaviour.
Figure 5:
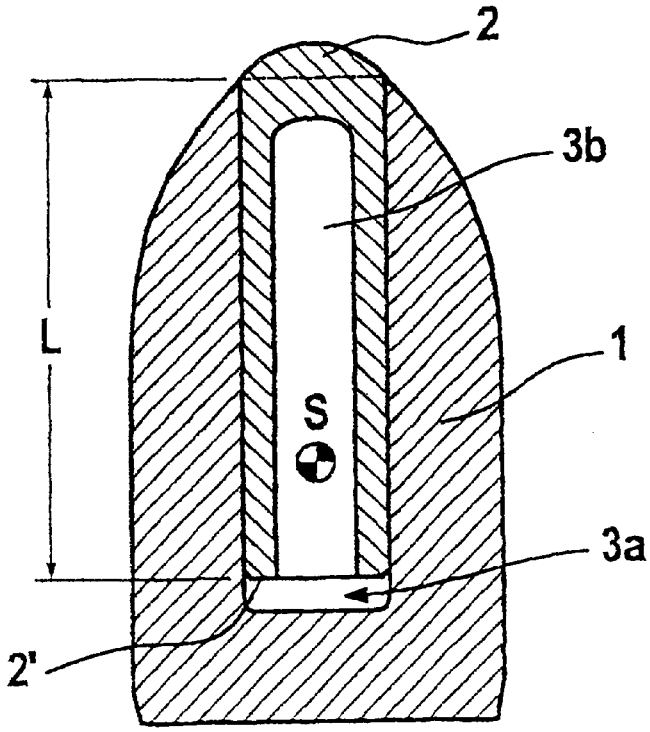
FIG. 5 shows a further variant of a projectile with increased penetration capacity.

The further exemplary embodiments shown in FIGS. 4 and 5 are based on the same principle. Compared with FIG. 1, the two projectiles have a center of gravity S displaced towards the leading end and the rear end, respectively. The projectile shown in FIG. 4 is constructed with thinner walls compared with FIG. 1 and is therefore more readily deformable; it has a lower ricochet characteristic.

The construction shown in FIG. 5 has a larger mass and hence a higher penetration capacity. The other advantages are maintained, so that a high energy deposition in the target is still effected; likewise, it does not disintegrate in the target. The length L remains stationary in the projectile itself throughout the entire ballistic trajectory of the projectile.

It may be of special advantage, however, when the cylindrical sleeve core 2 shown in FIG. 1, because of a correspondingly selected fit, becomes already displaced into the annular space 3*a* at discharge, so that the front portion of the base member 1 lies exposed about the displaced sleeve core and mushrooms very strongly because of the increased surface pressure.

In practice, it has been shown that the variant that becomes displaced at discharge has proved better, especially for police action, than the variant that is not displaced until it is in the target, because the more markedly mushroomed front portion delivers a large part of the kinetic energy to the surface (clothing, etc) and hence the penetration depth of the projectile is reduced and at the same time produces an intensified shock effect, resulting in less resistance. The wound ballistics are therefore further improved, without the projectile tip being able to cause injury before firing and/or the projectile tip being readily susceptible to mechanical damage.

Figure 6:
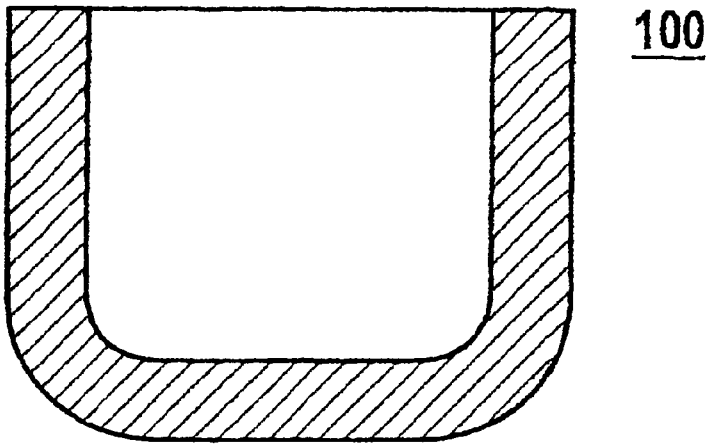
FIG. 6 shows a cup produced by deep drawing, as a preliminary stage for forming a base member for the projectile.
Figure 7:
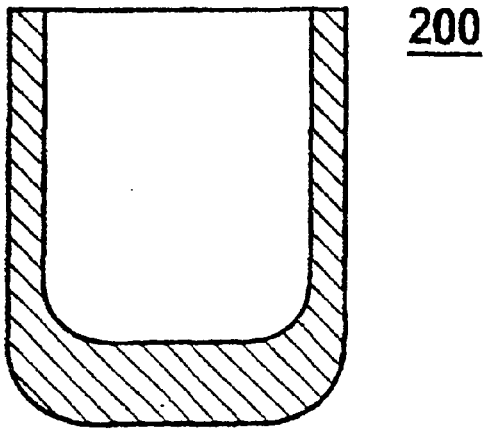
FIG. 7 shows a cup, as a preliminary stage for forming a sleeve core.

Ductile tombac (commercially available brass alloy of the firm Trier Walzwerke GmbH, D-54296 Trier), especially in the form of strip stock, has proved successful for manufacturing the projectiles. As is customary in deep drawing processes, circular discs (round blanks) were used to make a cup 100 of the kind shown in FIG. 6 for the base member 1, and a cup of the kind shown in FIG. 7, a cup 200, for the sleeve core.

The complete exclusion of turned parts and the use of conventional deep drawing and moulding processes made possible by the projectile form permits an economical manufacture, notwithstanding the improved end-ballistic properties of the projectiles.

The subject matter of the invention is intended for practical reasons for small-calibre projectiles (up to 0.5" diameter) and was designed for that purpose; however, it can be adapted in similar or analogous form also for larger projectiles.

We claim:

1. A small calibre deformation projectile providing high penetration against hard targets with limited mushrooming upon target impact, comprising:

an outer hollow-cylindrical base member with a rear base and an ogive-shaped or conical front region constructed to mushroom upon target impact; and means for controlling and limiting the mushrooming, said means comprising an at least partly cylindrical sleeve core having an end face inserted with a non-positive fit in, and projecting beyond, the front of the base member in a front position, a hollow space being formed between the sleeve core end face and the rear base of the base member, the non-positive fit being chosen such that at least on target impact of the projectile the sleeve core is displaced axially into the annular space into a rear position with its end face in contact with the base member.

2. The projectile according to claim 1, characterised in that the base member and the sleeve core consist of an identical copper/zinc alloy.

3. The projectile according to claim 1 or 2, characterised in that a peripheral annular space is provided between the base member and the sleeve core.

4. The projectile according to claim 1 or 2, characterised in that the sleeve core has a cylindrical part with a blind bore and that at least one of the blind bore and the cylindrical part have a conicity.

5. A method for the manufacture of the projectile of claim 1 from a copper/zinc alloy comprising the steps of forming both the base member and sleeve core by separate deep drawing and moulding processes to form cylindrical members, at least the base member being hollow and subsequently pressing the cylindrical sleeve core so formed into the hollow cylinder of the base member with a force fit such that at least between the base and the sleeve core the hollow space is formed, which space extends across the entire inner diameter of the base member.

6. The method according to claim 5, characterised in that the base member is punched as a circular disc of from flat material, the circular disc being shaped in the deep drawing processes to a hollow-cylindrical member and, after a subsequent calibration, being squeezed to a predetermined length of the base member.

7. The method according to claim 5, characterised in that the sleeve core is punched from flat material, the circular disc being shaped in the deep drawing processes to a hollow-cylindrical body and, after a subsequent calibration, being squeezed to a predetermined length of the sleeve core.

8. The method according to claim 6 or 7, characterised in that the flat material is strip stock and is fed from a roller to a stamping press or stamping and drawing press.

9. The method according to claim 5, characterised in that the step of pressing the sleeve core into the hollow cylinder of the base member comprises the steps of inserting the sleeve core into the base member and pressing both parts together by a shaping die at their end faces to a positive fit and with no transitions therebetween.

* * * * *